US007080627B2

(12) United States Patent
Watanabe

(10) Patent No.: US 7,080,627 B2
(45) Date of Patent: Jul. 25, 2006

(54) THROTTLE CONTROL DEVICE FOR INTERNAL COMBUSTION ENGINES

(75) Inventor: Shinji Watanabe, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 11 days.

(21) Appl. No.: 11/028,604

(22) Filed: Jan. 5, 2005

(65) Prior Publication Data

US 2005/0274355 A1 Dec. 15, 2005

(30) Foreign Application Priority Data

Jun. 9, 2004 (JP) ..... P2004-171425

(51) Int. Cl.
*F02D 41/08* (2006.01)

(52) U.S. Cl. ..... 123/399; 123/339.25; 123/339.14

(58) Field of Classification Search ..... 123/399, 123/339.14, 339.25
See application file for complete search history.

(56) References Cited

U.S. PATENT DOCUMENTS 5,492,095 A * 2/1996 Hara et al. ..... 123/399
5,521,825 A * 5/1996 Unuvar et al. ..... 123/399
5,669,351 A * 9/1997 Shirai et al. ..... 123/399
6,223,719 B1 * 5/2001 Yano et al. ..... 123/339.14
6,510,839 B1 * 1/2003 Pursifull ..... 123/339.25
6,879,902 B1 * 4/2005 Nada ..... 123/339.14

FOREIGN PATENT DOCUMENTS

JP 7-293284 A 11/1995

* cited by examiner

*Primary Examiner*—Erick R Solis
(74) *Attorney, Agent, or Firm*—Sughrue Mion, PLLC

(57) ABSTRACT

A throttle control device having a quick response and a control stability in the ISC running mode of an internal combustion engine comprises: feedback control means for outputting an amount of activation for activating a drive motor by using a predetermined control gain such that the real opening of a throttle valve detected by a throttle opening sensor for detecting the real opening of the throttle valve may be equalized to either a desired opening based on at least the depression of the accelerator pedal or a desired opening at the ISC time based on at least the speed of the internal combustion engine; and correction coefficient adjusting means for correcting the activation amount outputted from the feedback control means, with a predetermined correction coefficient on the basis of the decision result of a throttle operation mode deciding means for deciding the operation mode of the throttle valve.

8 Claims, 6 Drawing Sheets

FIG. 2

| | | | | | |
|---|---|---|---|---|---|
| KPMAP | KP(1) | KP(2) | —— | KP(i-1) | KP(i) |
| KIMAP | KI(1) | KI(2) | —— | KI(i-1) | KI(i) |
| KVMAP | KV(1) | KV(2) | —— | KV(i-1) | KV(i) |
| ERRTBL | ERROR(1) | ERROR(2) | —— | ERROR(i-1) | ERROR(i) |

KPMAP: MAP OF PROPOTIONAL CONTROL CONSTANTS
KIMAP: MAP OF INTEGRAL CONTROL CONSTANTS
KVMAP: MAP OF DIFFERENTIAL CONTROL CONSTANTS
ERRTBL: DEVIATION (REAL THROTTLE VALVE OPENING - DESIRED OPNING) TABLE

THROTTLE CONTROL DEVICE FOR INTERNAL COMBUSTION ENGINES

BACKGROUND OF THE INVENTION

1. Field of the Invention

This invention relates to a throttle control device for an internal combustion engine, in which the real opening of a throttle valve disposed in the intake air passage of the internal combustion engine is feedback-controlled to a desired opening.

2. Description of the Related Art

The disclosure of JP-A-7-293284 is enumerated as the throttle control device for an internal combustion engine, which is known in the related art. The control device, as disclosed in the Publication, uses the known PID (Proportion Integration differentiation) control arithmetic procedure basically as the control arithmetic processing for feedback (F/B) controlling the real opening of the throttle valve to a desired opening. In order to obtain the amount of activation for a quick valve drive even when the opening deviation (i.e., the desired opening—the real opening) of the real opening to the desired opening is small, moreover, the PID control gain is set variable according to the opening deviation, as shown in FIG. 2, and the PID control gain map is prepared so that the value of the control gain may be large when the opening deviation is small. By thus setting the control gain variable for the opening deviation, the activation amount can be quickly enlarged to reduce the opening deviation even when the opening deviation is small.

However, the aforementioned throttle control device of the related art fixes the control gain which is retrieved when an equal opening deviation occurs. It is, therefore, difficult to control the motor torque such that the throttle valve is quickly driven when a minute opening deviation occurs in the entire temperature range of the throttle valve operation and such that the real opening may not overshoot or undershoot from the desired opening. For example, when the motor temperature changes to change the motor winding resistance according to the running state of the internal combustion engine, the motor current value does not takes an equal value even for the equal value of the motor control voltage. When the equal opening deviation occurs, therefore, the control DUTY value and the motor control voltage value to be calculated by control means are controlled to the equal value by the PID control operation. Even with this control, however, the motor current value is changed by the change in the motor winding resistance by the motor temperature so that the motor drive torque proportional to the motor current is not controlled to the equal value. In short, the motor drive torque to be controlled and outputted when the equal opening deviation occurs is higher at the lower temperature and the lower at the higher temperature.

The motor control line takes the higher gain at the lower temperature, as described above. It is, therefore, general to adapt the control gain so that no control hunting may occur at the low temperature. In this case, the gain of the motor control line is lowered in the operation at the high temperature by the rise in the motor winding resistance. When a minute opening deviation occurs, therefore, the torque necessary for driving the valve is not quickly outputted to delay the response to the real opening (as referred to FIG. 4A). When the control gain is adapted for the quick valve drive at the high temperature, on the other hand, the gain becomes excessive at the low temperature so that a hunting of the real opening occurs (as referred to FIG. 4B). This raises a problem that the PID control gain generally has to be adapted for avoiding the opening hunting at the low temperature while sacrificing the opening responsiveness at the high temperature. Here in FIGS. 4A to 4C: letter L designates a desired value; letter M designates a control response at the low temperature; and letter N designates a control response at the high temperature.

SUMMARY OF THE INVENTION

In the idle speed control running mode (i.e., ISC running mode) of the internal combustion engine, the throttle opening has to be quickly changed against the various engine load/torque fluctuations (for the air conditioner, the power steering, the lights, the N-D operation and so on), so that the intake air flow of the engine may be adjusted to control the engine torque thereby to attain a stable engine speed.

An object of the invention is to provide a throttle control device for an internal combustion engine, which can have a quick response and a control stability in the ISC running mode of the internal combustion engine.

According to this invention, there is provided a throttle control device of an internal combustion engine for controlling the opening of a throttle valve by the operation of an accelerator pedal. The throttle control device comprises: a throttle valve; a drive motor; an throttle opening sensor for detecting the real opening of the throttle valve; feedback control means for outputting an amount of activation for activating the drive motor by using a predetermined control gain such that the real opening of the throttle valve detected by the throttle opening sensor may be equalized to either a desired opening based on at least the depression of the accelerator pedal or a desired opening at the ISC time based on at least the speed of the internal combustion engine; throttle operation mode deciding means for deciding the operation mode of the throttle valve; and correction coefficient adjusting means for correcting the activation amount outputted from the feedback control means, with a predetermined correction coefficient on the basis of the decision result of the throttle operation mode deciding means.

According to a first aspect of the invention, there can be provided a throttle valve control device of an internal combustion engine for controlling the opening of a throttle valve by the operation of an accelerator pedal, comprising: a throttle valve; a drive motor for the throttle valve; a throttle opening sensor for detecting the real opening of the throttle valve; feedback control means for outputting an amount of activation for activating the drive motor by using a predetermined control gain so that the real opening of the throttle valve detected by the throttle opening sensor may be identical to either a desired opening based on at least the depression of the accelerator pedal or a desired opening at an ISC time based on at least the speed of the internal combustion engine; throttle operation mode deciding means for deciding the operation mode of the throttle valve and correction coefficient adjusting means for correcting the activation amount outputted from the feedback control means with a predetermined correction coefficient on the basis of the decision result of the throttle operation mode deciding means. The throttle control device of the invention is capable of performing a correction processing with a simple configuration of a process logic and at an appropriate manner, and enables to make compatible the quick response of the real opening and the stability of the control at the time of change of a desired opening, thereby attaining an optimum controllability.

According to a second aspect of the invention, moreover, the correction coefficient is changed by the correction coefficient adjusting means into a first predetermined correction coefficient, in case the throttle operation mode other than the ISC running time after the warm-up is decided by the throttle operation mode deciding means, and into a predetermined second correction coefficient in the throttle operation mode other than the aforementioned one, so that the activation amount outputted from the feedback control means is corrected and outputted. In the operation other than the ISC running time after the warm-up, therefore, the activation amount outputted from the feedback control means is directly outputted with the first correction coefficient (=1.0), to avoid the unnecessary correction at the time when the minute opening deviation occurs, thereby to reduce the power consumption and retain the control stability. At the ISC running time after the warm-up, the response delay, as might otherwise be caused by the drive torque shortage due to the increase in the winding resistance at the high temperature of the DC motor, is avoided by the second correction coefficient even when the minute opening deviation occurs. Thus, it is possible to provide a throttle control device for an internal combustion engine, which can make compatible the quick response of the real opening and the stability of the control.

According to a third aspect of the invention, moreover, the throttle operation mode deciding means makes the decision on the basis of at least the depression amount of the accelerator pedal and the cooling water temperature of the internal combustion engine. Thus, it is possible to provide a throttle control device for an internal combustion engine, which can decide the ISC running state at the ISC running time of the internal combustion engine especially after the warm-up and can correct the activation amount of the throttle actuator according to the operation mode of the throttle valve, as set according to the running state of the engine, thereby to provide a throttle control device which can make compatible the quick response of the real opening and the stability of the control when the desired opening changes.

According to a fourth aspect of the invention, moreover, the adjustment of the correction coefficient by the correction coefficient adjusting means makes a gradual change at the changing time from the first correction coefficient to the second correction coefficient, and makes a quick change at the changing time from the second correction coefficient to the first correction coefficient. As a result, the control disturbance due to the abrupt increase in the DUTY value at the time when the running state shifts to the ISC running after the engine warm-up can be suppressed to avoid the unnecessary correction at the shifting time to the running state other than the ISC running after the warm-up, thereby to provide a throttle control device which can make compatible the quick response and the control stability.

According to a further aspect of the invention, moreover, the second correction coefficient is learned and corrected by the responding operation of the real opening. Thus, it is possible to provide a throttle control device for an internal combustion engine, which can achieve a stable controllability even against the individual difference of the throttle actuator.

Here, the present invention is applied to the feedback control arithmetic value, but similar effects can be obtained even if the invention is applied, for example, to a feed-forward control arithmetic value other than the feed back control arithmetic value. On the other hand, no description is made on the correction of the activation amount on the actuator against the battery voltage fluctuations. However, the correction should naturally be taken into consideration.

The foregoing and other objects, features, aspects and advantages of the present invention will become more apparent from the following detailed description of the present invention when taken in conjunction with the accompanying drawings.

BRIEF DESCRIPTION OF THE DRAWINGS

FIG. 2 is a table of relations between opening deviations and set control gain values;

FIG. 4A shows the throttle valve operations of the case, in which a controlled gain is adapted to a low temperature, FIG. 4B shows the throttle valve operations of the case, in which the controlled gain is adapted to a high temperature, and FIG. 4C shows the throttle valve operations of the case, in which a controlled variable is corrected at a high temperature;

DESCRIPTION OF THE PREFERRED EMBODIMENTS

Figure 1:
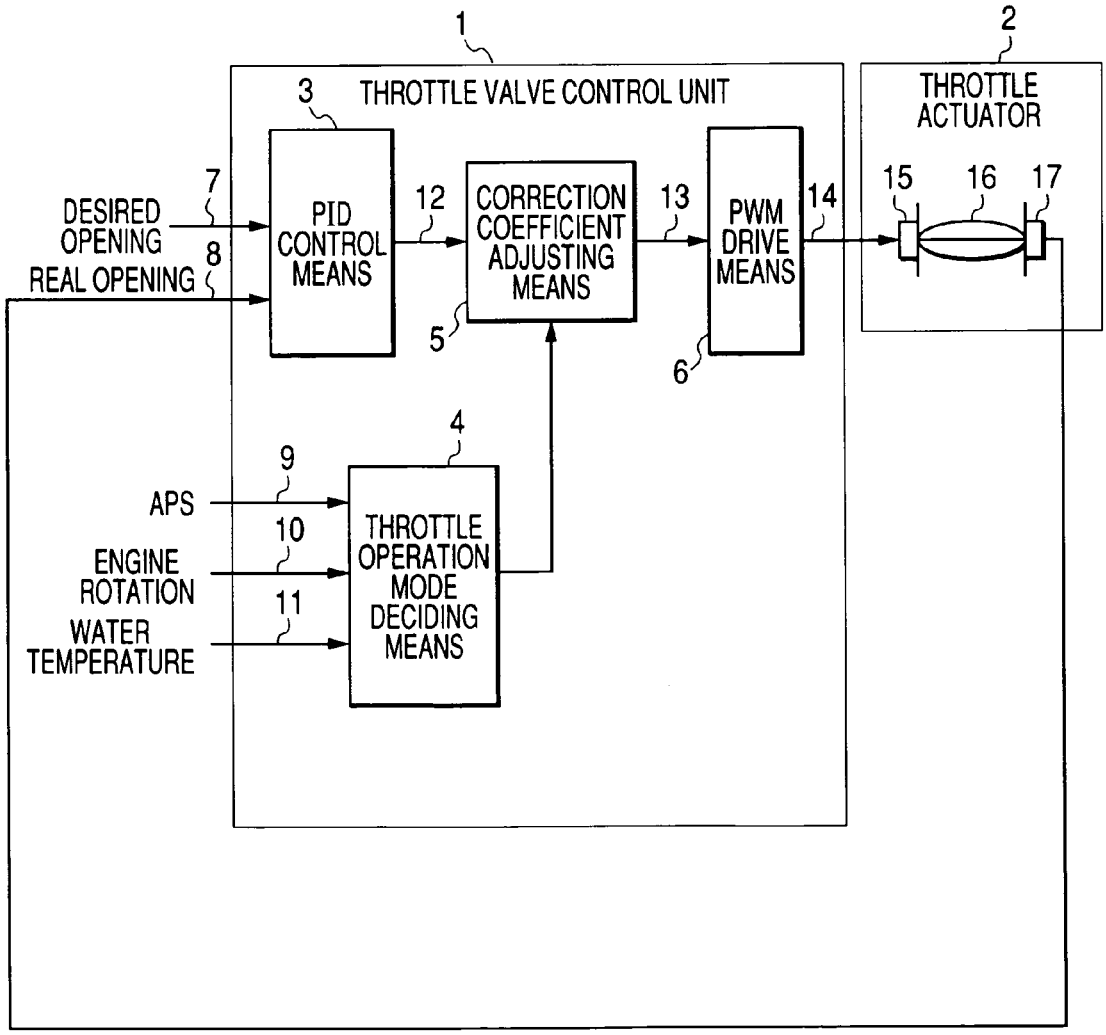
FIG. 1 is a diagram showing a schematic configuration of a throttle control device for an internal combustion engine according to Embodiment 1 of the invention.

FIG. 1 to FIG. 4 show a throttle control device for an internal combustion engine according to Embodiment 1 of the invention. FIG. 1 shows a schematic configuration diagram of the throttle control device which includes a throttle valve control unit 1 and a throttle actuator 2. The throttle valve control unit 1 is configured to include: PID control means 3 fed with a desired opening 7, which is set according to an accelerator position sensor (APS) output 9, an engine speed 10, an engine cooling water temperature (or an engine water temperature) 11 and so on, and a real opening 8, which is detected by a throttle position sensor (TPS) 17, for calculating a DUTY value 12 for controlling a motor voltage, on the basis of an opening deviation between the desired opening 7 and the real opening 8, by an opening feedback control operation using the well-known PID control operation; throttle operation mode deciding means 4 fed with the APS output 9, the engine speed 10 and the engine water temperature 11 for deciding the throttle operation mode at the ISC running time after the engine warm-up; correction coefficient adjusting means 5 for correcting the DUTY value 12 outputted from the PID control means 3, by changing a correction coefficient on the basis of the decision result of the throttle operation mode deciding means 4, to output a corrected DUTY value 13; and PWM drive means 6 fed with the corrected DUTY value 13 for outputting a motor control valve 14 controlled by the PWM drive.

On the other hand, the throttle actuator 2 is configured such that a drive motor 15 is activated with the motor control valve 14 outputted from the PWM drive means 6, such that the driving force of the drive motor 15 is transmitted through the (not-shown) reduction gear to a throttle valve 16, and such that the real opening 8 of the throttle valve 16 is detected by a TPS 17 mounted on the throttle valve shaft.

Figure 3:
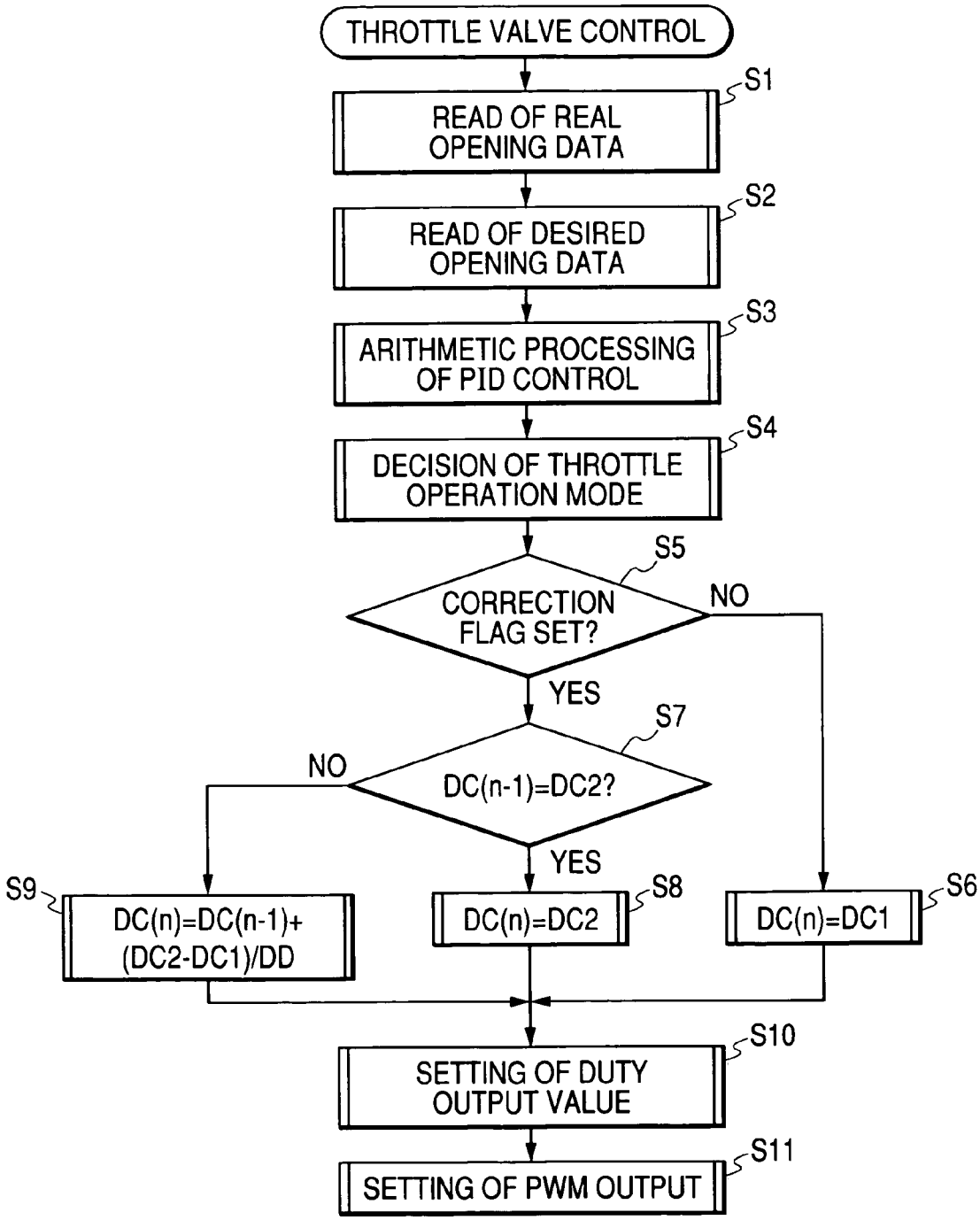
FIG. 3 is a flow chart of a throttle valve controlling routine of Embodiment 1.
Figure 4A:
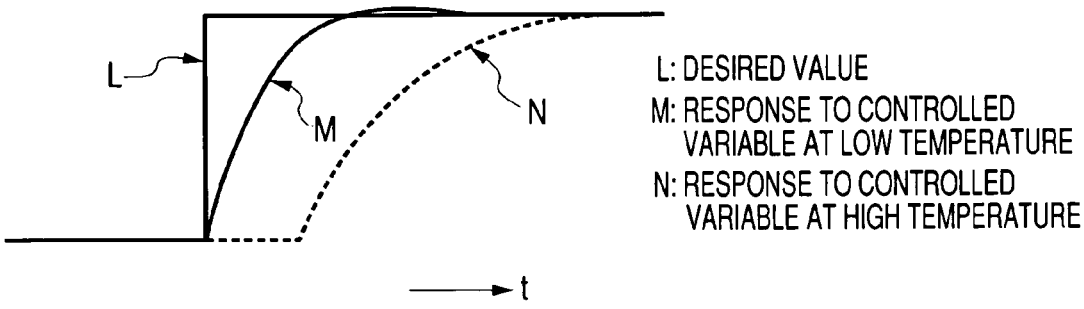
FIGS. 4A to 4C presenting graphs showing the operating characteristics of a throttle valve.
Figure 4B:
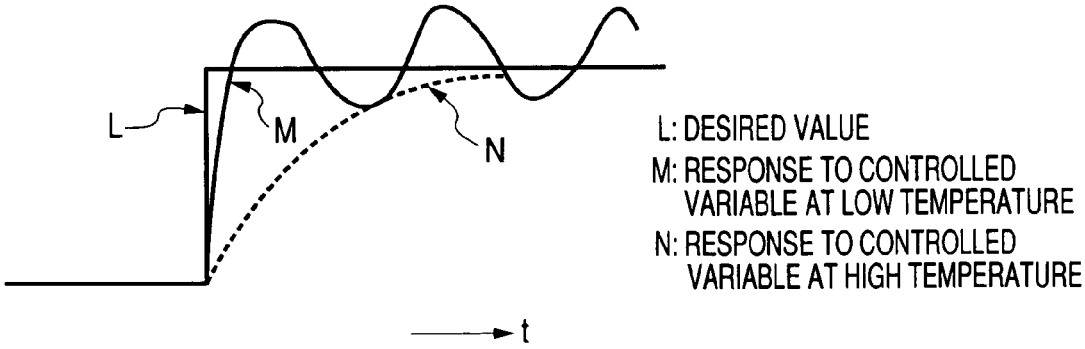
Figure 4C:
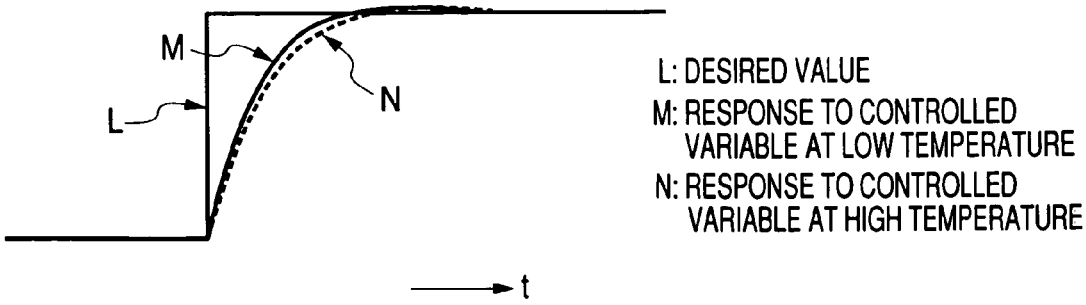

The operations are described in the following. FIG. 3 is a flow chart showing the processed contents on the throttle valve control of the throttle control device for the internal combustion engine. In the throttle valve control unit 1, the following operations are performed at every predetermined control periods (e.g., 2.5 ms).

At Step S1, the real opening 8 of the throttle valve 16 is read by A/D-inputting a voltage outputted from the TPS 17. At Step S2, an engine control unit reads the desired opening, which is set on the basis of the APS output 9 for outputting a voltage proportional to the depression of an accelerator pedal, the engine speed 10, the engine water temperature 11 and so on, as the desired opening 7.

Next, at Step S3, the PID control means 3 performs an arithmetic processing of the PID control on the basis of the desired opening 7 and the real opening 8, which are sampled for every control periods. At first, the absolute value of the opening deviation (=the desired opening 7−the real opening 8) (n) is determined from the desired opening 7(*n*) and the real opening 8(*n*), which are sampled at this sampling timing n. On the basis of the absolute value ERROR(i) of the opening deviation, a proportional control gain KP (i), an integral control gain KI(i) and the differential control gain KV(i) are read from a control gain map, as shown in FIG. 2. A proportional term (P) is calculated from the product of the proportional control gain KP and the opening deviation. An integral (I) term is calculated from the product of the integral control gain KI and the integral value of the opening deviation. A differential (D) term is calculated from the differential control gain KD and the real opening change {=the real opening (n)−the real opening (n−1)}. Moreover, the proportional term (P), the integral (I) term and the differential (D) term are added to calculate the DUTY value 12.

Next, at Step S4, on the basis of the APS output 9, the engine speed 10 and the engine water temperature 11 which are inputted to the throttle operation mode deciding means 4, it is decided whether or not the DUTY value 12 calculated by the PID control means 3 is to be corrected, and a correction flag is operated. In the cases where the APS output 9 is at the accelerator pedal fully-closed position, where the engine water temperature is at a predetermined value (e.g., 80° C.) or higher and where the engine speed 10 is at a predetermined value (within a range of 500 r/m to 1,500 r/m, for example), it is decided that the internal combustion engine is in the ISC running state after the engine warm-up, and the correction flag is set to correct the DUTY value 12. In case it is decided that the throttle operation mode is other than the ISC running state after the engine warm-up, the correction flag is cleared.

At Step S5, the correction flag is checked by the correction coefficient adjusting means. In case the correction flag is cleared, a correction coefficient DC (n) at this sampling time is set to a first correction coefficient DC1 (e.g., 1.0), and the DUTY value 12 is corrected to the corrected DUTY value 13 multiplied by the correction coefficient DC1 and is set as the DUTY output value (at Step S10). In this case, the first correction coefficient DC1 is 1.0 so that the DUTY value 12 is directly outputted without any correction. When the engine transfers to the throttle operation mode other than the ISC running state after the warm-up, therefore, the correction coefficient is promptly changed to the first correction coefficient DC1.

In case the correction flag is set at Step S5, the operation of Step S7 is performed. When the DUTY value 12 as the output of the PID control means 3 is to be corrected, it is decided at Step S7 whether or not the correction coefficient DC(n−1) at the previous sampling time is equal to a second correction coefficient DC2 (e.g., 1.3). If this answer is YES, the correction coefficient DC(n)=DC2 at this sampling time is corrected to the corrected DUTY value 13 which is corrected by multiplying the DUTY value 12 by the second correction coefficient DC2, and this corrected DUTY value 13 is set as the DUTY output value (at Step S10). At the throttle valve control time in the ISC running state after the engine warm-up, therefore, the DUTY value 12 as the arithmetic result of the PID control is corrected with the second correction coefficient DC2. The drive motor 15 is activated to drive the throttle valve 16 with the output of the PWM drive means 6 based on the corrected DUTY value 13.

In case the correction coefficient DC(n−1) at the previous sampling time is not equal to the second correction coefficient DC2, the correction coefficient DC(n) at this sampling time is calculated at Step S9 as the correction coefficient DC(n−1) at the previous sampling time+(the second correction coefficient DC2−the first correction coefficient DC1)/(a correction coefficient updating constant DD (e.g., 16)). The DUTY value 12 is corrected to the corrected DUTY value 13 multiplied by the correction coefficient DC (n) at this sampling time, and this corrected DUTY value is set as the DUTY output value (at Step S10). As a result, the first correction coefficient DC1 is gradually changed to the second correction coefficient DC2.

At Step S11, the corrected DUTY value 13 is inputted to the PWM drive means 6. In this PWM drive means 6, the PWM drive DUTY ratio is set to the corrected DUTY value so that a voltage proportional to the DUTY value is fed to the drive motor 15 thereby to perform a F/B control, in which the real opening 8 of the throttle valve 16 is equalized to the desired opening 7. By the routine thus far described, the throttle actuator 2 in the ISC running state after the engine warm-up is enabled to make compatible the quick response of the real opening and the stability of the control at the time when an especially fine change of the desired opening is demanded (as referred to FIG. 4C).

Embodiment 2

In Embodiment 1 thus far described, the second correction coefficient DC2 is fixed. In Embodiment 2, on the other hand, the base value DC2 of the second correction coefficient is learned and corrected (by ΔDC2) on the basis of the response results of the real opening to the desired opening change at the ISC running time after the internal combustion engine was warmed up, so that a second learned correction coefficient value DCL2 is set.

Figure 5:
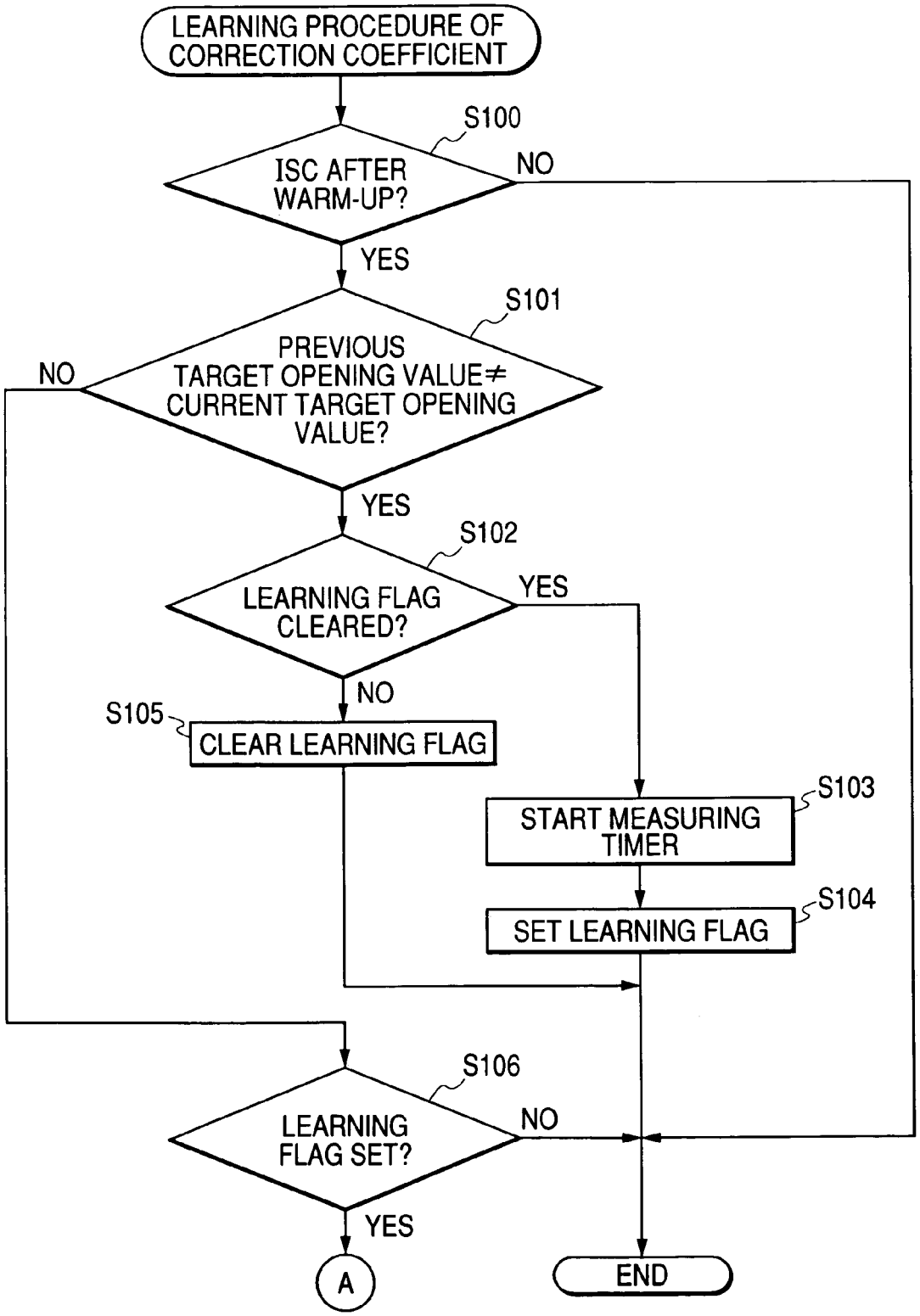
FIG. 5 is a (partial) flow chart showing a throttle valve controlling routine of a throttle control device for an internal combustion engine according to Embodiment 2 of the invention.
Figure 6:
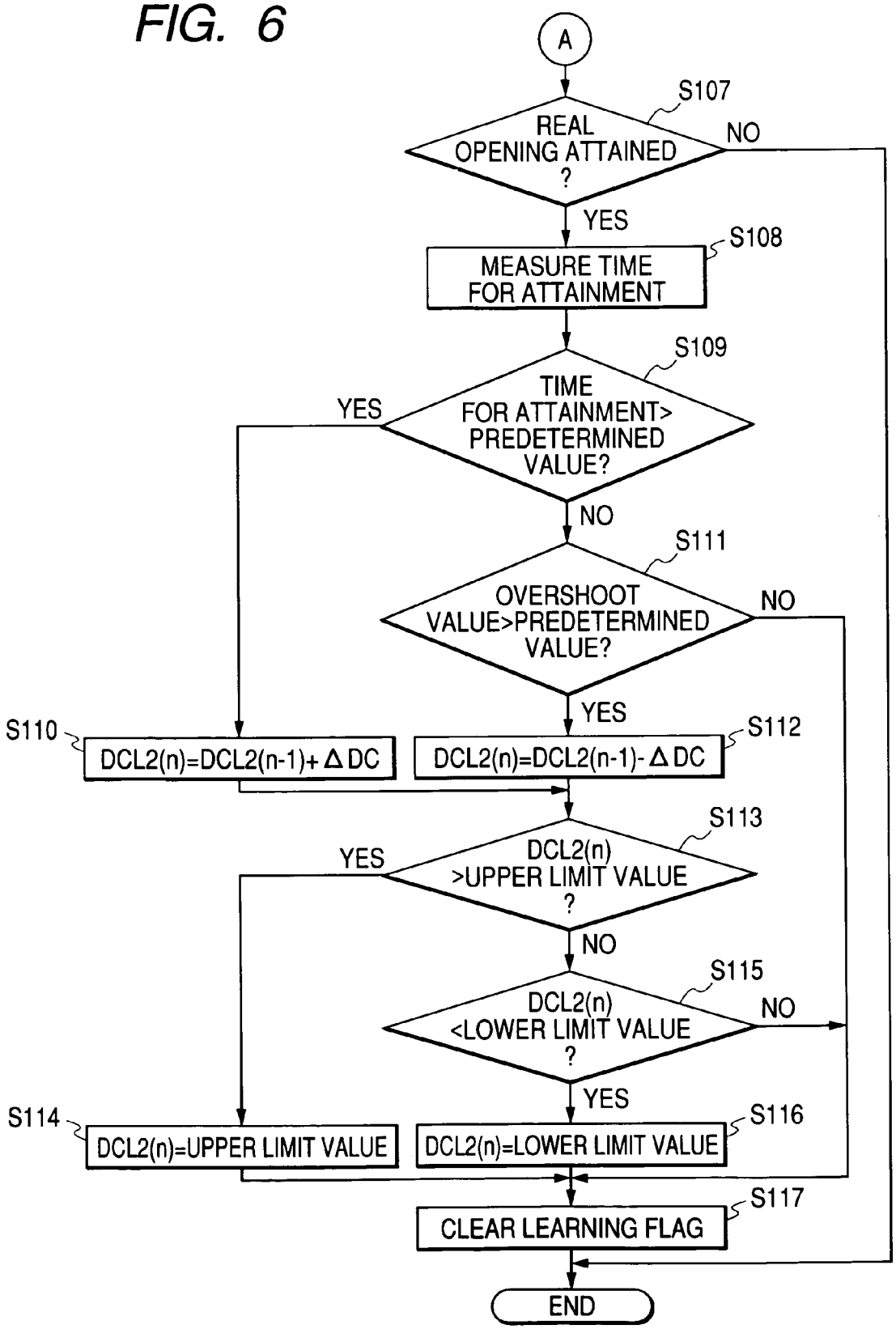
FIG. 6 is a (partial) flow chart showing the throttle valve controlling routine of the throttle control device for an internal combustion engine according to Embodiment 2 of the invention.

The operations to learn the second correction coefficient will be described with reference to the flow charts of the learning procedures of the correction coefficient of FIG. 5 and FIG. 6. Here, letter A of FIG. 5 indicates an advance to A of FIG. 6. At Step S100 of FIG. 5, it is decided by the throttle operation mode deciding means 4 whether or not the internal combustion engine is in the ISC running mode after the warm-up. If this answer is No, the routine is ended. In case it is decided that the internal combustion engine is in the ISC running mode, it is decided at Step S101 whether or not the desired opening at the previous control time and the desired opening at this control time are not equal to each other. If this answer is No, the desired opening has changed at this control time, and it is decided at Step S102 from the set state of a learning flag whether or not an operation to learn the second correction coefficient DC2 is to be done.

In case the learning flag is cleared, the learning operation of the second correction coefficient DC2 is executed. For this execution, a timer for measuring the time period for the real opening to attain the desired opening is started at Step S103, and the learning flag is set at Step S104 to end the routine. In case the learning flag is set at Step S102, the desired opening has varied again during the learning operation. In order to end the learning operation forcibly, therefore, the learning flag is cleared at Step S105 to end the routine.

In case it is decided at Step S101 that the desired opening at the previous control time and the desired opening at this control time are equal to each other, it is decided at Step S106 from the learning flag whether or not the second correction coefficient DC2 is being learned. The routine is ended in case the learning flag is cleared, but the learning operation is performed at Step S107 of FIG. 6 in case the learning flag is set.

At Step S107, it is decided whether or not the real opening has attained the desired opening. The routine is ended in case the real opening has failed. In case the real opening has attained, the time for the attainment is measured at Step S108 from the timer. Next, it is decided at Step S109 whether or not the time for the real opening to attain the desired opening is longer than a predetermined value (e.g., 0.1 secs). In the longer case, a second learned correction coefficient DCL2 at this time is subjected to the addition of the second learned correction coefficient DCL2 (n−1) at the previous learning time and a learning correction valve ΔDC (e.g., 0.01), and the routine advances to Step S113. At Step S109, the excess value of {the overshoot (O/S) value or the undershoot (U/S) value} of the real opening from the desired opening is determined from the peak valve of the opening deviation (ERROR) between the real opening and the desired opening after the time for the attainment, and it is decided at Step S111 whether or not the overshoot value is larger than a predetermined value (e.g., 0.5 degs).

In case the excess value is larger than the predetermined value, the second learned correction coefficient DCL2(*n*) at this time is calculated at Step S112 by subtracting the learning correction vale (e.g., 0.01) from the second learned correction coefficient DCL2 (n−1) at the previous learning time, and the routine advances to Step S113. In case it is decided at Step S111 that the overshoot value is less than the predetermined value (e.g., 0.5 degs), both the time for the real opening to attain the desired opening and the excess amount are within the predetermined values, and the learning correction is not needed. At Step S117, therefore, the learning flag is cleared to end the learning routine.

At Step S113, it is decided whether or not the second learned correction coefficient DCL2(*n*) at this time is more than a predetermined upper limit value (e.g., 1.4). In case this upper limit value is exceeded, the second learned correction coefficient DCL2(*n*) is set at Step S114 to the upper limit value, and the learning flag is cleared (at Step S117) to end the learning routine. In case it is decided at Step S113 that the second learned correction coefficient DCL2(*n*) at this time is less than the predetermined upper limit value (e.g., 1.4), the routine advances to Step S115. In case it is decided at Step S115 that the second learned correction coefficient DCL2(*n*) is less than the lower limit value (e.g., 1.2), the coefficient DCL2(*n*) is set at Step S116 to the lower limit value, and the learning flag is cleared (at Step S117) to end the learning routine. By the learning operations thus far described, advantages similar to those of Embodiment 1 can also be obtained for the individual dispersions of the throttle actuator 2.

The throttle control device for the internal combustion engine according to the invention can be applied to the controls of the automotive engine.

While the presently preferred embodiments of the present invention have been shown and described. It is to be understood that these disclosures are for the purpose of illustration and that various changes and modifications may be made without departing from the scope of the invention as set forth in the appended claims.

What is claimed is:

1. A throttle valve control device of an internal combustion engine for controlling the opening of a throttle valve by the operation of an accelerator pedal, comprising: a throttle valve; a drive motor for said throttle valve; a throttle opening sensor for detecting the real opening of said throttle valve; feedback control means for outputting an amount of activation for activating said drive motor by using a predetermined control gain so that the real opening of the throttle valve detected by said throttle opening sensor may be identical to either a desired opening based on at least the depression of said accelerator pedal or a desired opening at an ISC time based on at least the speed of the internal combustion engine; throttle operation mode deciding means for deciding the operation mode of said throttle valve; and correction coefficient adjusting means for correcting said activation amount outputted from said feedback control means with a predetermined correction coefficient on the basis of the decision result of said throttle operation mode deciding means.

2. A throttle control device for an internal combustion engine according to claim 1, wherein said throttle operation mode deciding means decides the throttle operation mode at the ISC running time after the warm-up on the basis of at least the depression of the accelerator pedal and the cooling water temperature of the internal combustion engine.

3. A throttle valve control device of an internal combustion engine for controlling the opening of a throttle valve by the operation of an accelerator pedal, comprising: a throttle valve; a drive motor for said throttle valve; a throttle opening sensor for detecting the real opening of said throttle valve; feedback control means for outputting an amount of activation for activating said drive motor by using a predetermined control gain so that the real opening of the throttle valve detected by said throttle opening sensor may be identical to either a desired opening based on at least the depression of said accelerator pedal or a desired opening at an ISC time based on at least the speed of the internal combustion engine; throttle operation mode deciding means for deciding the operation mode of said throttle valve; and correction coefficient adjusting means for correcting said activation amount outputted from said feedback control means with a predetermined correction coefficient on the basis of the decision result of said throttle operation mode deciding means, wherein the correction coefficient is adjusted to a first correction coefficient by said correction coefficient adjusting means, in case it is decided by said throttle operation mode deciding means that the operation of said throttle valve is in a throttle operation mode other than that at the ISC running time after the warm-up of the internal combustion engine, but the correction coefficient is adjusted to a second correction coefficient by said correction coefficient adjusting means in case it is decided that the operation mode of said throttle valve is in the throttle operation mode at the ISC running time after the warm-up.

4. A throttle control device for an internal combustion engine according to claim 3, wherein said throttle operation mode deciding means decides the throttle operation mode at the ISC running time after the warm-up on the basis of at least the depression of the accelerator pedal and the cooling water temperature of the internal combustion engine.

5. A throttle control device for an internal combustion engine according to claim 3, wherein the adjustment of the correction coefficient by said correction coefficient adjusting means makes a gradual change at the changing time from said first correction coefficient to said second correction coefficient, and makes a quick change at the changing time from said second correction coefficient to said first correction coefficient.

6. A throttle control device for an internal combustion engine according to claim 3, wherein said second correction coefficient is learned and corrected on the basis of the responding operation result of the real opening at the desired opening changing time in the ISC running state after the warm-up.

7. A throttle control device for an internal combustion engine according to claim 3, wherein said second correction coefficient is learned and corrected on the basis of the responding operation result of the real opening at the desired opening changing time in the ISC running state after the warm-up, in case the time for the real opening to attain the desired opening is other than a predetermined time in the responding operation result of the real opening at the desired opening changing time, the second correction coefficient is learned and corrected in an increasing direction, and in case an overshoot value or an undershoot value of the real opening from the desired opening is equal to or more than a predetermined value, second correction coefficient is learned and corrected in a decreasing direction.

8. A throttle control device for an internal combustion engine according to claim 3, wherein said second correction coefficient is limited in its learned correction range.

* * * * *